US006439204B1

(12) United States Patent
Duquette

(10) Patent No.: US 6,439,204 B1
(45) Date of Patent: Aug. 27, 2002

(54) TIMING ADVANCE PISTON FOR UNIT PUMP OR UNIT INJECTOR AND METHOD THEREOF

(75) Inventor: Mark Duquette, Andover, CT (US)

(73) Assignee: Stanadyne Corporation, Windsor, CT (US)

( * ) Notice: Subject to any disclaimer, the term of this patent is extended or adjusted under 35 U.S.C. 154(b) by 48 days.

(21) Appl. No.: 09/638,758

(22) Filed: Aug. 14, 2000

Related U.S. Application Data

(60) Provisional application No. 60/149,756, filed on Aug. 19, 1999.

(51) Int. Cl.[7] ..... F02M 37/04
(52) U.S. Cl. ..... 123/506; 123/508
(58) Field of Search ..... 123/500, 501, 123/502, 503, 506, 507, 509, 508

(56) References Cited

U.S. PATENT DOCUMENTS

| | | | | |
|---|---|---|---|---|
| 3,951,117 A | * | 4/1976 | Perr | 123/450 |
| 4,036,192 A | * | 7/1977 | Nakayama | 123/467 |
| 4,235,374 A | | 11/1980 | Walter et al. | 239/90 |
| 4,249,499 A | | 2/1981 | Perr | 123/502 |
| 4,378,775 A | | 4/1983 | Straubel et al. | 123/458 |
| 5,033,442 A | | 7/1991 | Perr et al. | 123/502 |
| 5,193,510 A | | 3/1993 | Straubel | 123/502 |
| 5,209,403 A | | 5/1993 | Tarr et al. | 239/91 |
| 5,335,852 A | | 8/1994 | Muntean et al. | 239/89 |
| 5,411,003 A | | 5/1995 | Eberhard et al. | 123/502 |
| 5,419,298 A | * | 5/1995 | Nolte et al. | 123/508 |
| 5,460,133 A | * | 10/1995 | Perr et al. | 123/446 |
| 5,979,416 A | * | 11/1999 | Berger | 123/468 |
| 6,009,858 A | * | 1/2000 | Teerman | 123/506 |
| 6,145,493 A | * | 11/2000 | Espey | 123/456 |

FOREIGN PATENT DOCUMENTS

| | | |
|---|---|---|
| DE | 40 06 367 A1 | 9/1991 |
| JP | 09303161 | 11/1997 |

* cited by examiner

*Primary Examiner*—Tony M. Argenbright
*Assistant Examiner*—Hai Huynh
(74) *Attorney, Agent, or Firm*—Alix, Yale & Ristas, LLP

(57) ABSTRACT

A fuel injector unit pump, driven by a cam function to supply fuel to an injector for an injection event. The fuel injector unit pump includes a body and a pumping plunger reciprocably disposed within the body and has a driven end. A cam follower assembly is provided for engaging the cam and includes an advance piston that engages the driven end of the pumping plunger for advancing or retarding the timing of the injection event. The advance piston is movable in response to fluid pressure controlled by an advance control. A follower return spring is disposed between the body and the cam follower assembly and a plunger return spring is mounted coaxially with the follower return spring and between the body and the advance piston. The advance piston includes a main cavity and the cam follower assembly includes a housing and the fuel injector unit pump may also include a balance spring disposed between the main cavity of the advance piston and the housing of the cam follower assembly.

21 Claims, 9 Drawing Sheets

TIMING ADVANCE PISTON FOR UNIT PUMP OR UNIT INJECTOR AND METHOD THEREOF

CROSS REFERENCE TO RELATED APPLICATION

This application claims the benefit of U.S. Provisional Application No. 60/149,756, filed Aug. 19, 1999.

BACKGROUND OF THE INVENTION

The present invention pertains to high pressure fuel injection pumps. More particularly, the invention is directed to improving fuel injection timing for high pressure fuel injection unit pumps or unit injectors.

Internal combustion engines may rely on high pressure fuel injection pumps to pressurize a supply of fuel for injection into the engine combustion chamber. The high pressure fuel injection pump designs available to accomplish fuel pressurization and injection vary widely. One known fuel injection pump design uses discrete fuel injection unit pumps each typically coupled to a single combustion chamber of the engine. Each unit pump includes a pumping chamber defined by a longitudinal pumping bore within the unit pump body and a pumping plunger disposed for reciprocation therein. The pumping chamber is terminated by a head assembly which is connected to the engine combustion chamber, typically by a high pressure line and fuel injector. A fuel supply port fluidly connects the pumping bore to a fuel supply source.

The pumping plunger has a pumping end and an opposing driven end. A cam follower assembly is disposed between the plunger pumping end and a rotatable cam. The rotatable cam acts against the cam follower assembly to periodically force the pumping plunger toward the head, thereby pressurizing the fuel within the pumping chamber for discharge to the engine combustion chamber. A spring biases the pumping plunger, and thereby the cam follower assembly, against the rotatable cam. The spring bias ensures that the pumping plunger and cam follower assembly maintain continuous contact with the cam, so that the pumping plunger periodically moves away from the head and thereby draws fuel from the supply port into the pumping chamber.

The cam is mechanically coupled in a well known manner to an engine crankshaft which is in turn mechanically coupled to engine pistons reciprocating within engine cylinders. In this manner, the rotational angle of the cam is in a fixed relationship to the linear position of the engine piston within its cylinder. Likewise, the rotational angle of the cam is mechanically related to the linear position of the pumping plunger within the pumping bore. The relationship of the cam with both the engine pistons and pumping plunger allows control of the timing of the plunger pumping stroke so that fuel can be injected into the engine combustion chamber when the engine piston is at a desired position in its linear travel. Typically, fuel is injected before the piston has reached the top of its stroke.

Control of fuel injection timing is important for engine cold starting and power output. Control of fuel supplied to the combustion chamber of an internal combustion engine by a fuel injection pump has also become increasingly important due to the demand for improved fuel economy and increasingly stringent legislation controlling emissions emanating from internal combustion engines. In particular, control of the timing at which the unit pump starts and ends the injection of fuel into the combustion chamber is important in meeting these demands. One known method for controlling the delivered fuel quantity in conjunction with the timing of the fuel injection event with a unit pump or unit injector provides the pumping plunger outside diameter with upper and lower helical channels. As the plunger reciprocates, the helical channel intermittently aligns with the supply port, or alternatively a spill port. As the pumping plunger travels toward the head the upper helical channel moves out of alignment with the fill port, generating high pressure in the pumping chamber, and the fuel injection event begins. As the pumping plunger continues movement toward the head, the lower helical channel is aligned with the fill port and the fuel injection event ends. Rotation of the pumping plunger within the pumping bore serves to adjust the timing for the alignment of the helical channels and fill/spill ports, thereby adjusting the delivered fuel quantity and timing of the fuel injection event.

SUMMARY OF THE INVENTION

It is an object of the invention to provide an additional mechanism for varying the timing of the fuel injection event.

It is another object of the present invention to provide a method and apparatus for controlling the timing of a fuel injection event, the method and apparatus providing an optimal combination of simplicity, reliability, efficiency and versatility.

It is yet another object of the invention to provide an apparatus for controlling the timing of a fuel injection event which contains the relationship between the linear position of the pumping piston and the rotational angle of the cam.

These and other objects and advantages of the present invention are achieved by the use of a fuel injector unit pump, driven by a cam that functions to supply fuel to an injector for an injection event. The fuel injector unit pump includes a body and a pumping plunger reciprocably disposed within the body and has a driven end. A cam follower assembly is provided for engaging the cam and includes an advance piston that engages the driven end of the pumping plunger for advancing or retarding the timing of the injection event. The advance piston is movable in response to fluid pressure controlled by an advance control. A follower return spring is disposed between the body and the cam follower assembly and a plunger return spring is nested with the follower return spring and between the body and the advance piston.

The advance piston is hydraulically actuated and is disposed between the rotatable cam and pumping plunger. In a retracted position the pumping plunger is separated from the cam rotational axis by a first distance. The first distance defines a relationship between the pumping plunger linear position, cam rotational angle and engine piston position. By pressurizing the advance piston, the advance piston is moved outwardly toward an extended position, which in turn displaces the pumping plunger away from the cam rotational axis. Since the position of the pumping plunger within the pumping bore determines fuel injection event timing, for the same cam rotational angle the fuel injection event timing will be different depending on whether the advance piston is retracted or extended. Naturally, the fuel injection timing is continuously variable within the range of advance piston displacement. The range of advance piston displacement is also known as advance authority. An advance piston displacement range of 3 mm is possible.

To avoid separation of the pumping plunger and cam follower assembly from the cam, a follower return spring with a high spring force and spring rate is often used. Given the relatively small advance piston size it is difficult to apply a sufficient hydraulic pressure against the advance piston to overcome the force of the follower return spring. A balance spring can be placed below the advance piston to nearly balance the force of the return spring; however, the high spring rates of the return and balance springs severely limit the advance authority achievable with this configuration. An increased advance authority is achievable by using a pair of nested return springs.

In accordance with another feature of the invention, an outer cam follower assembly return spring provides a high force through a follower spring seat against the cam follower assembly, thereby maintaining the cam follower assembly against the cam as the cam rotates. An inner plunger return spring with a low force and low spring rate acts through a plunger spring seat against only the advanced piston to prevent separation of the plunger from the advance piston. Since the advance piston is biased only by the plunger return spring, pressurized lubricating oil from the engine lubrication system can be routed through a hydraulic advance circuit to hydraulically actuate the advance piston.

A control device fluidly upstream or downstream of the advance piston controls pressure within the hydraulic advance circuit, thereby controlling actuation of the advance piston, and ultimately timing of the fuel injection event.

Preferably, the advance piston includes an annular channel or step at the piston crown. This step cooperates with an annular shoulder formed on the inside diameter of the follower spring seat to limit the maximum displacement of the advance piston, and thereby the ultimate advance authority achievable. Further, preferably, the follower spring seat incorporates a retainer such as tabs or a lip to retain the follower spring during assembly.

BRIEF DESCRIPTION OF THE DRAWINGS

Other objects and advantages of the invention will be evident to one of ordinary skill in the art from the following detailed description made with reference to the accompanying drawings, in which.

DESCRIPTION OF THE PREFERRED EMBODIMENTS

Figure 1:
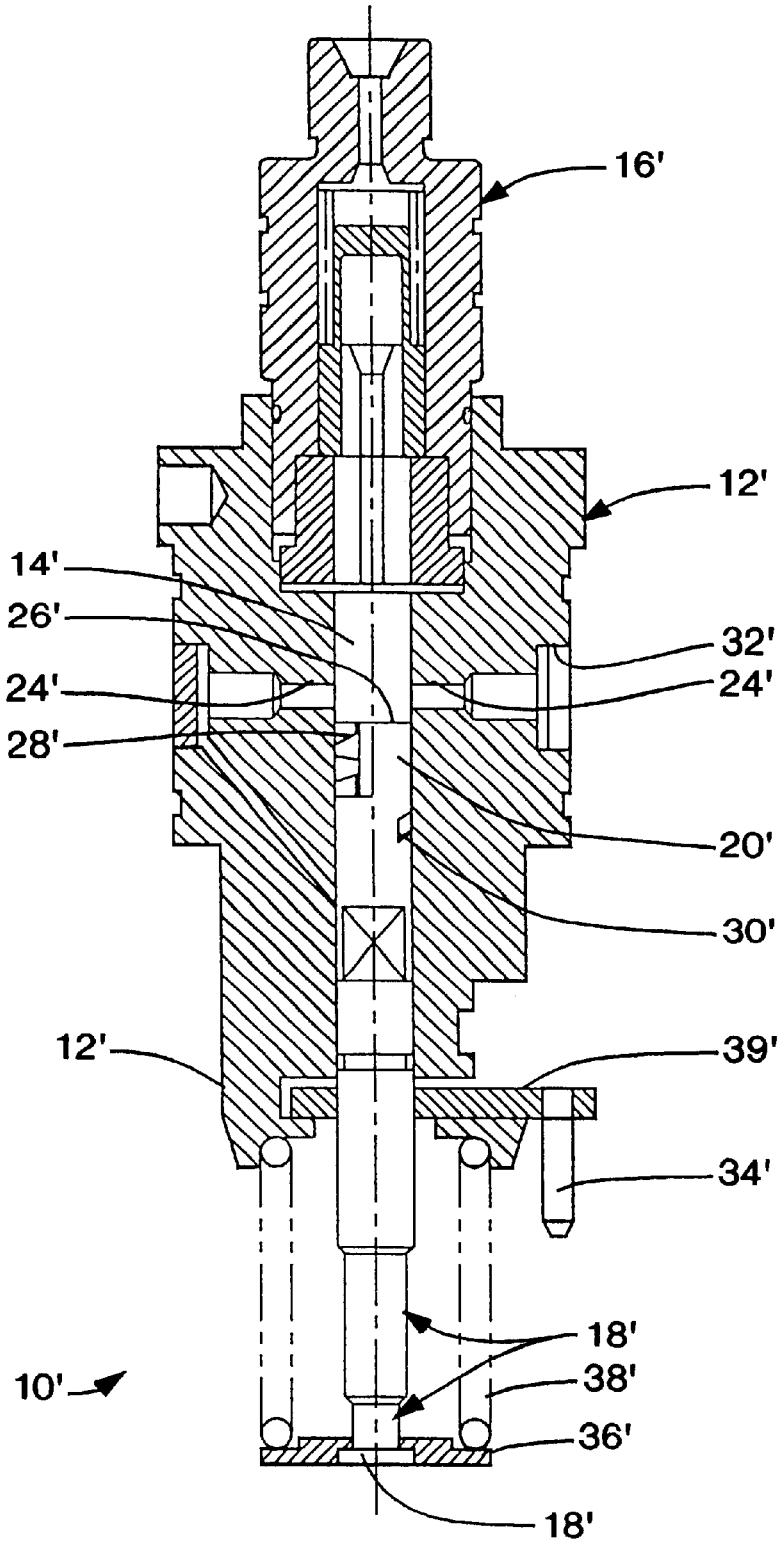
FIG. 1 (PRIOR ART)
FIG. 1 is a partial sectional view of a prior art unit pump or unit injector.

FIG. 1 illustrates at 10' a conventional fuel injection unit pump or unit injector. The unit pump 10' comprises a body 12' defining a longitudinal pumping bore 14' with a head 16' mounted at one end of the body and coaxially with the bore. A generally cylindrical pumping plunger 18' is disposed within the pumping bore for reciprocal motion therein. The pumping plunger 18' has a pumping end 20' disposed toward the head 16' and an opposing driven end 22' projecting from the unit pump body. A fill/spill port 24' is provided within the body 12' and movement of a leading edge 26' of the plunger pumping end 20' past the fill/spill port defines the beginning of an injection event. Upper and lower helical channel portions 28' and 30' partially surround the outside diameter of the pumping plunger 18'. Alignment of lower helical channel portion 30' with fill/spill port 24' serves to define the end of the fuel injection event. Fuel supply port 32' is in fluid communication with the fill/spill port 24'.

Also shown is a pin 34' mounted to a control arm 36' for rotation of the pumping plunger 18' within the pumping bore 14'. Rotation of the pumping plunger 18' changes alignment of the helical channels in relation to the fill/spill port 24' and thereby the injection duration and by that the quantity of the fuel injected. The driven end 22' of the pumping plunger is mounted to a spring seat 36'. A coiled spring 38' is trapped between the unit pump body 12' and the spring seat 36' and functions to bias the pumping plunger 18' away from the head 16'.

Figure 2:
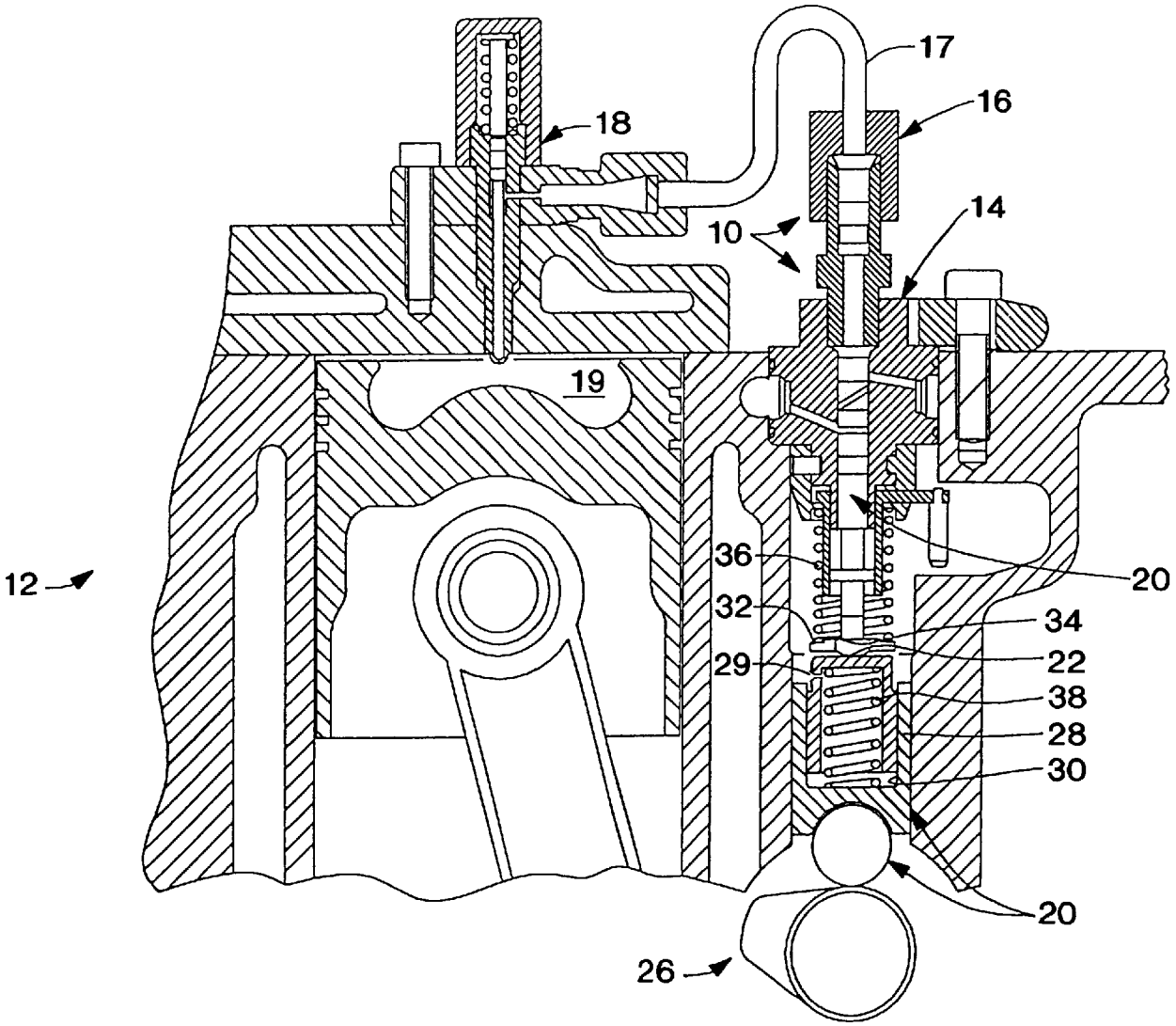
FIG. 2 is a fragmentary view, partly in section, of an internal combustion engine including an embodiment of a unit pump with an advance piston.

FIG. 2 illustrates generally at 10 a fuel injection unit pump installed in an internal combustion engine 12 in accordance with one embodiment of the present invention. The unit pump 10 comprises a body 14 and head 16 each of which may be conventional, with the head fluidly connected by fuel line 17 to a fuel injector 18 for injection of fuel into a combustion chamber 19 of the engine 12. A cam follower assembly 20 is disposed between a driven end 22 of a pumping plunger 24 and a cam 26. In a usual manner, the cam follower assembly 20 acts to change rotation of the cam 26 into reciprocating linear motion which is then translated to the pumping plunger 24.

In accordance with a feature of the present invention, an inverted cup shaped advance piston 28 is mounted within a bore 30 in the cam follower assembly 20. The advance piston 28 is configured such that the internal space between the advance piston and the cam follower assembly 20 can be pressurized via a hydraulic circuit, thereby displacing the advance piston away from the cam follower assembly which may range to a distance of about 3 millimeters.

The pumping plunger driven end 22 abuts the advance piston 28, so that displacement of the advance piston away from the cam follower assembly 20 similarly displaces the pumping plunger 24 away from the cam follower assembly 20 and cam rotational axis. The advance piston 28 may also comprise an aperture 29 for providing for the escape of any air caught within the advance piston 28 as described in more detail below.

A follower spring seat 32 engages a shoulder 34 on the pumping plunger driven end 22. A follower return spring 36 is captured between the unit pump body 14 and the spring seat 32 so that the pumping plunger driven end 22 is biased against the advance piston 28, thereby biasing the cam follower assembly 20 against the cam 26. In the embodiment shown in FIG. 2, a balance spring 38 is disposed between the cam follower assembly 20 and advance piston 28 to partially counteract the bias force exerted by the follower return spring 36 on the advance piston. As previously discussed, the high spring force and rate of the follower return spring 36 and balance spring 38 limits the advance authority available in this embodiment.

Figure 3:
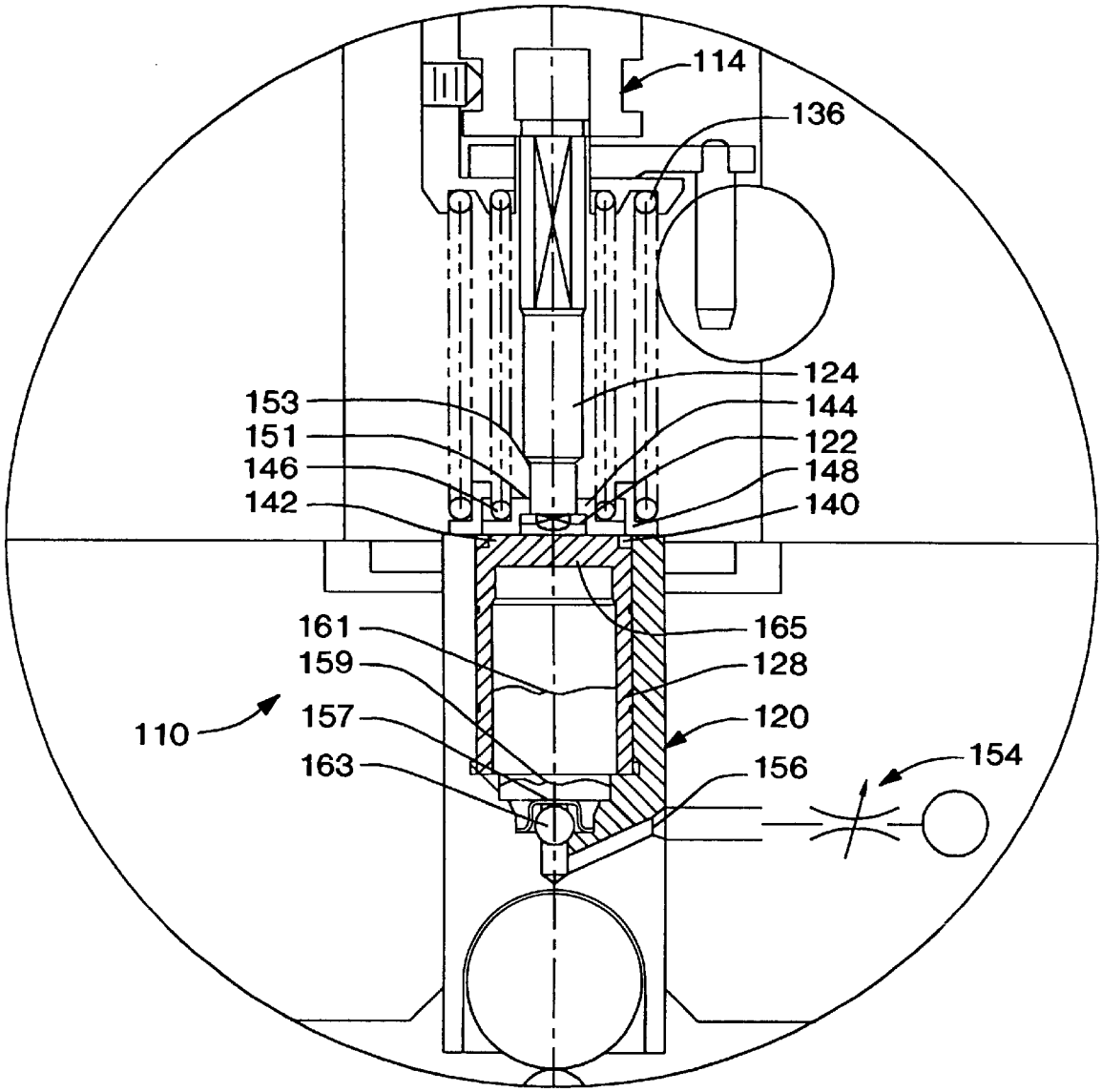
FIG. 3 is a fragmentary view, partly in section and partly schematic, of an embodiment of a unit pump including an advance piston and nested return springs.

FIG. 3 shows generally at 110 another embodiment of a fuel injection unit pump in accordance with the present invention. In this embodiment, an advance piston 128 is disposed within a cam follower assembly 120 disposed between a cam (not shown) and a pumping plunger driven end 122 in a manner similar to that described above. The advance piston 128 includes a circumferential slot or channel 140 at the advance piston crown 142 adjacent the pumping plunger driven end.

The pumping plunger driven end 122 is mounted to a plunger spring seat 144. A plunger return spring 146 surrounds a pumping plunger 124 and is trapped between a unit pump body 114 and the plunger spring seat 144. The plunger return spring 146 has a relatively low spring force of about 5 lb. of force and spring rate of about 75 lb/in. As can be seen from FIG. 3, the plunger spring seat 144 contacts the advance piston 128 but does not contact the cam follower assembly 120.

A cam follower return spring 136 surrounds the plunger return spring 146 and is trapped between the unit pump body 114 and a follower spring seat 148. The follower spring seat 148 coaxially surrounds the plunger spring seat 144 and is adjacent to the cam follower assembly 120. The cam follower return spring 136 has a high spring force of about 30 lb. of force and a spring rate of about 200 lb/in (for the given plunger spring parameters discussed above) to maintain the cam follower assembly 120 in continuous contact with the cam (not shown).

Figure 8:
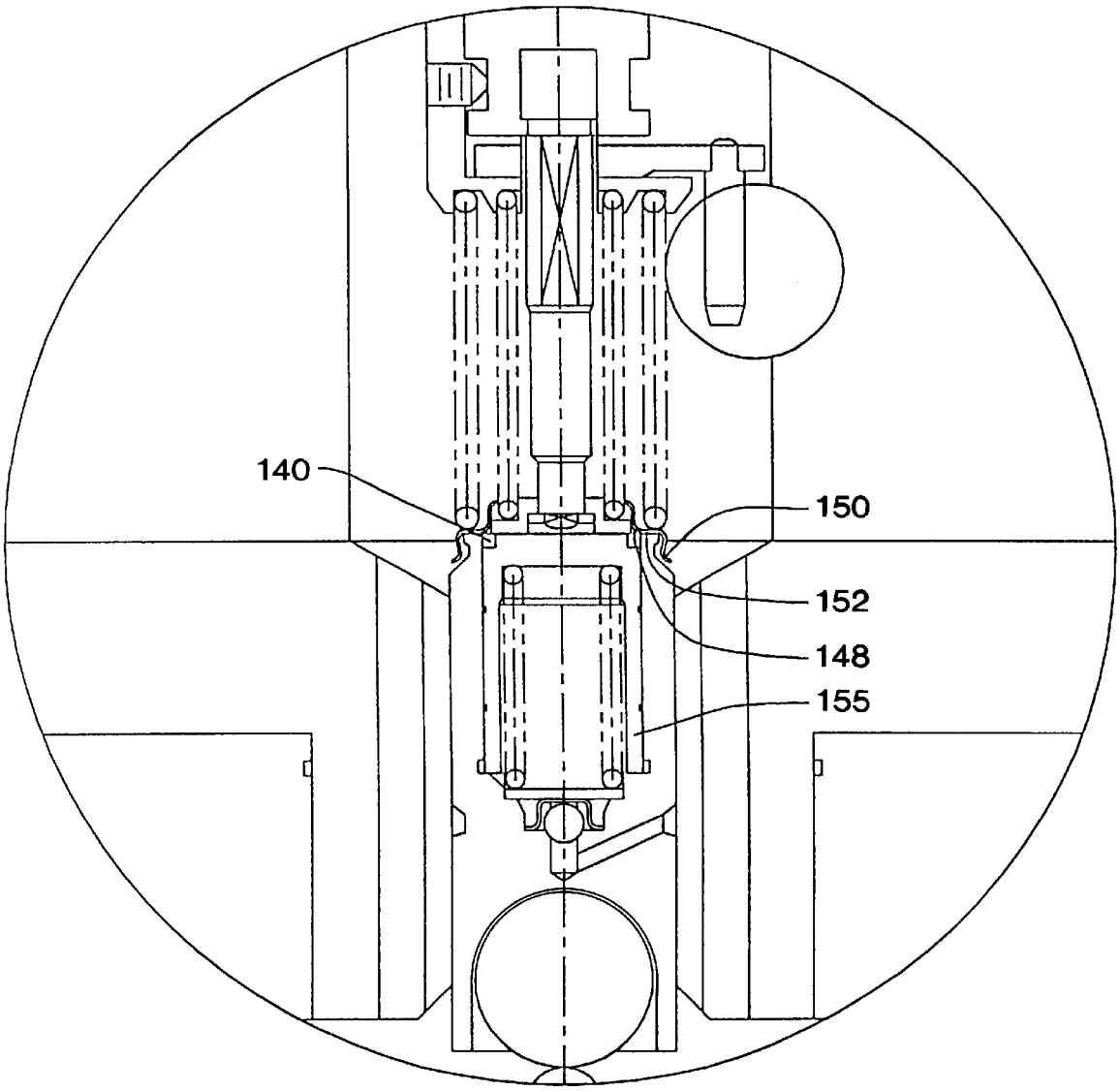
FIG. 8 is a view similar to FIG. 4 showing a different embodiment of the follower spring seat with dual retainers.

Referring also to FIG. 8, the follower spring seat 148 may comprise a retainer 150 that connects both the plunger return spring 146 and a housing 155 of the cam follower assembly 120. Use of the retainer 150 allows the unit pump body 114, plunger 124, plunger spring 146, follower spring 136 and cam follower assembly 120 to be handled, installed and removed as one piece.

The follower spring seat 148 includes an inwardly facing circumferential shoulder 152. When the advance piston 128 is in the retracted position, the advance piston circumferential channel 140 is axially separated from the follower spring seat shoulder 152. As a hydraulic advance circuit 154 pressurizes fluid within the advance piston 128, the advance piston is displaced away from the cam follower assembly 120 and the channel 140 approaches the follower seat annular shoulder 152. At the advance piston 128 maximum displacement, the channel 140 contacts the annular shoulder 152, preventing further movement of the advance piston. The depth dimension of the channel 140 defines the maximum possible advance piston 128 displacement and thereby the advance authority (a). The follower spring seat 148 preferably also has a lip or tabs which engage the plunger spring 146 and plunger spring seat 144 to retain the follower spring during pump installation in the engine (not shown). The plunger spring seat 144 may also comprise a lip or tabs 151 which engage a flange 153 of the pumping plunger driven end 122.

In this embodiment, the follower return spring 136 can impose high forces to maintain continuous contact of the cam follower assembly 120 with the cam. In spite of the use of a high force follower return spring 136, the advance piston 128 is opposed by only the lower force plunger return spring 146 until the advance piston has reached its maximum displacement. The use of nested follower return spring 136 and plunger return spring 146 allows the advance piston 128 to be actuated by relatively low pressure hydraulic supply, such as, for instance lubrication oil from the internal combustion engine pressurized lubrication system 154 which is discussed in more detail hereafter in conjunction with FIG. 6. Galleries in the engine and bore 156 of the cam follower assembly 120 may be configured to fluidly connect the advance piston 128 with the lubrication system. An input 157 located within a cavity 159 of the cam follower assembly 120 provides fluid to a main cavity 161 of the advance piston 128 via a check valve 163. The input 157 is located at an opposite end of the advance piston from an engagement wall 165 thereof.

Figure 4:
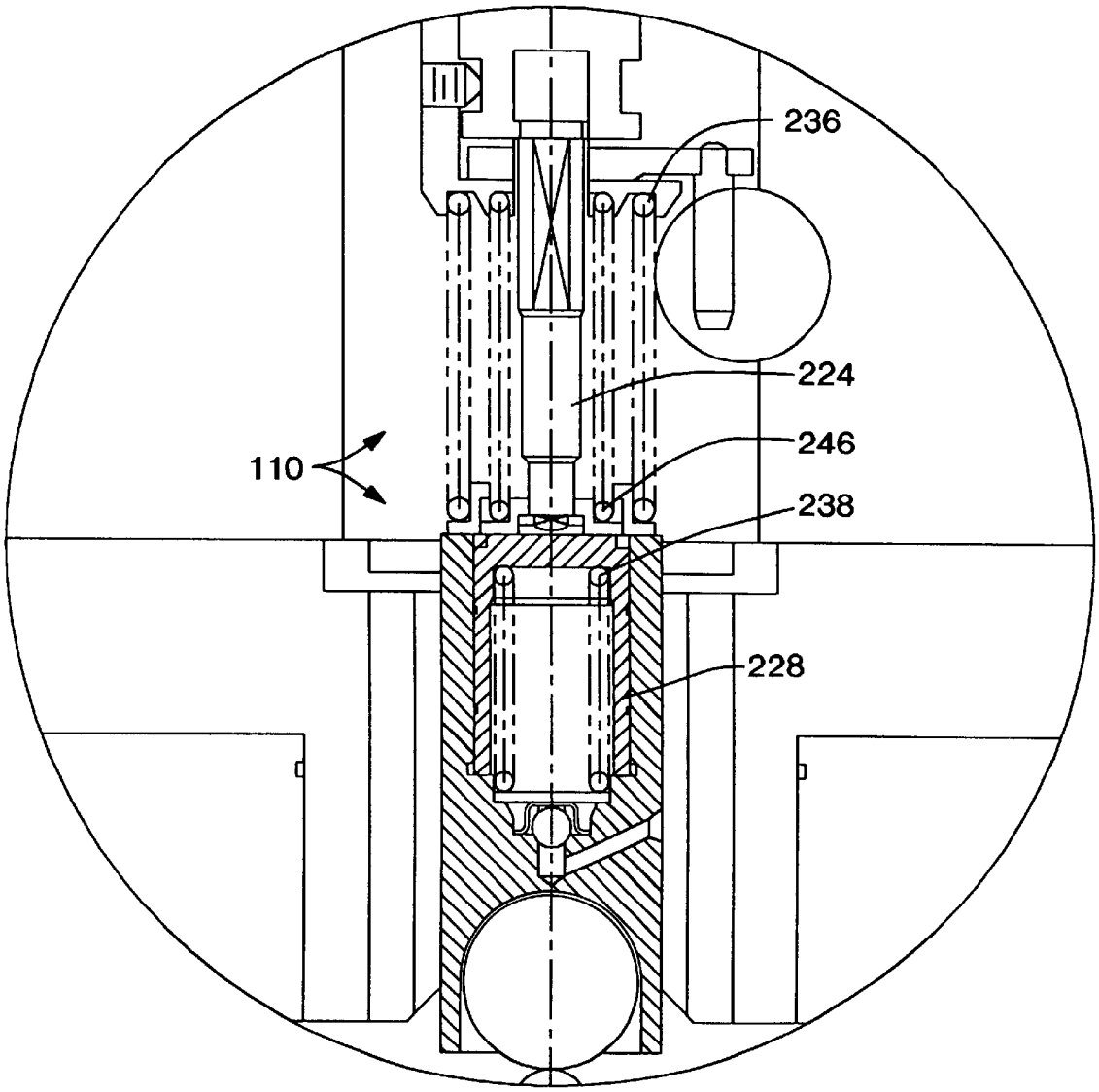
FIG. 4 is a view similar to FIG. 4 showing a different embodiment of the unit pump.

FIG. 4 shows generally at 210 another embodiment of an fuel injection unit pump similar to that shown in FIG. 3, although, in the embodiment of FIG. 4, a balance spring 238 is located between a cam follower assembly 220 and an advance piston 228. The balance spring 238 is employed to counterbalance the bias force imposed by a plunger return spring 246. Since the plunger return spring 246 is only used to prevent separation of a plunger 224 and the advance piston 228, against a cam (not shown), its spring force and rate is small, i.e., such as on the order of 10 lb. of force. Therefore, the balance spring 238 need only balance the low force imposed by the plunger return spring 246.

Figure 5C:
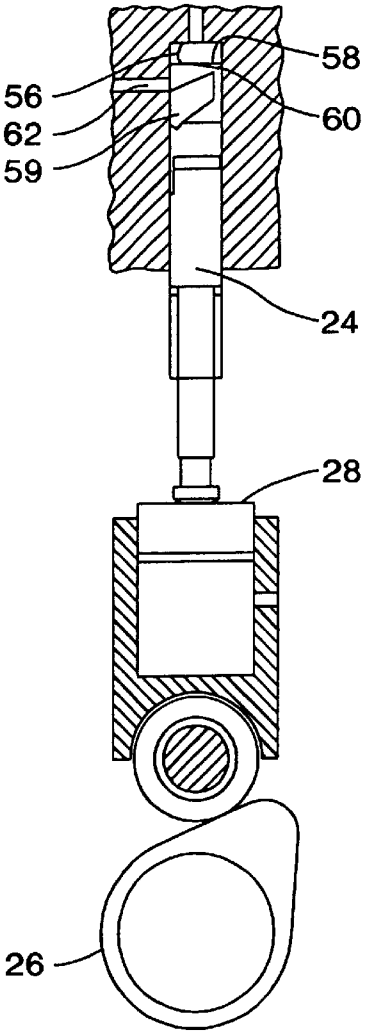
FIGS. 5*a*–5*c* are schematic views illustrating the change in the start of the fuel injection event with different advance piston displacements and also illustrating the end of the fuel injection timing event.
Figure 5B:
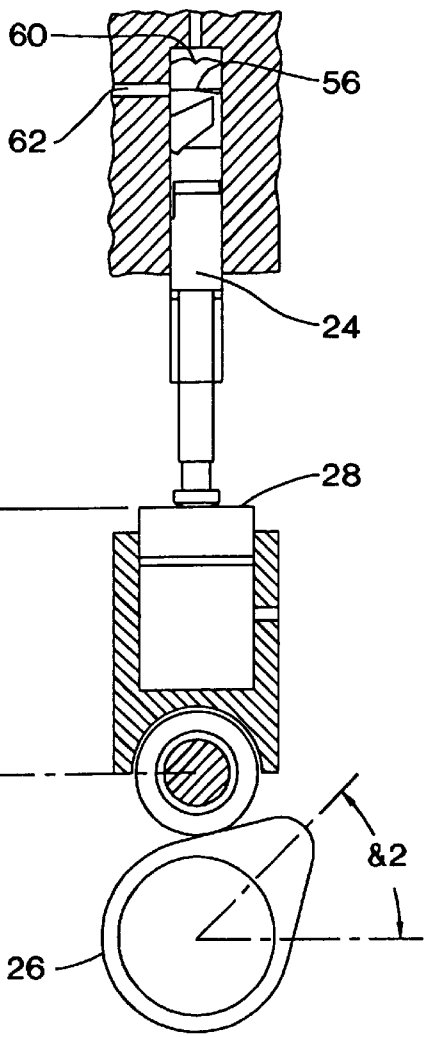
Figure 5A:
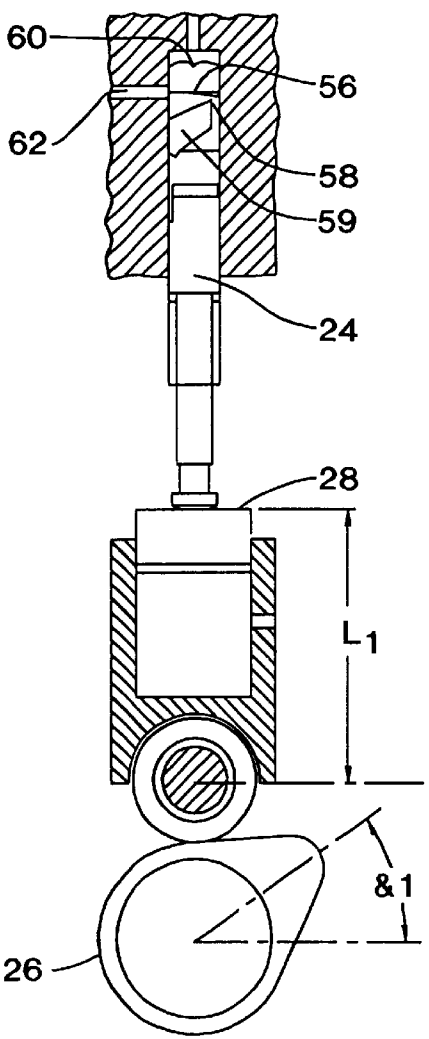

FIGS. 5*a* and 5*c* schematically illustrate a pumping stroke for generating a fuel injection event and FIG. 5*b* illustrates how displacement of the advance piston 28 changes the timing of the fuel injection event. While FIGS. 5*a* through 5*c* are discussed in conjunction with the embodiment of FIG. 2, it will be understood that the following discussion is equally applicable to each of the herein disclosed embodiments.

Referring now to FIGS. 5*a* and 5*c,* the pumping plunger 24 comprises a pumping end 56 which includes a grooved upper helix portion 58 and a grooved lower helix portion 59 and is located in a pumping chamber 60 communicating with a supply port 62. The pumping stroke (or "filling") starts when the grooved upper helix portion 58 of the pumping plunger 24 moves past the supply port 62 in the pumping chamber 60. Referring also to FIG. 2, fuel trapped in the pumping chamber 62 is forced by the pumping plunger 24 through the head 16 and high pressure fuel line 17 into the combustion chamber 19 of the internal combustion engine 12.

The end of the pumping stroke is shown in FIG. 5*c* and is defined by the alignment of the lower helical channel 59 and the supply port 62 in the pumping chamber 60. This fluidly couples the pressurized fuel remaining in the pumping chamber 60 with the supply port 62, allowing "spilling" of the pressurized fuel into the supply port.

FIG. 5*b* illustrates the advance piston 28 in a somewhat retracted position from that of FIG. 5*a*. As shown in FIG. 5*b,* retraction of the advance piston 28 requires additional angular rotation of the cam 26 for the pumping plunger 24 to start the pumping stroke. Thus, extension of the advance piston 28 allows the pumping stroke to be started at a comparatively sooner angular rotation of cam 26 thereby advancing the fuel injection timing. Retraction of the advance piston within the cam follower assembly allows the pumping stroke to be started at a comparatively later angular rotation of cam 26 thereby retarding the fuel injection timing.

Rotation of the pumping plunger 24 within the pumping chamber 60 varies the distance of the upper and lower helical channels to the supply port allowing a change in the length of the pumping stroke, in turn, varying the quantity of fuel provided thereby. It should be noted that varying the quantity of fuel in the fuel injection event imparted by rotation of the pumping plunger is independent of, and in addition to, that provided by displacement of the advance piston 28.

Figure 6:
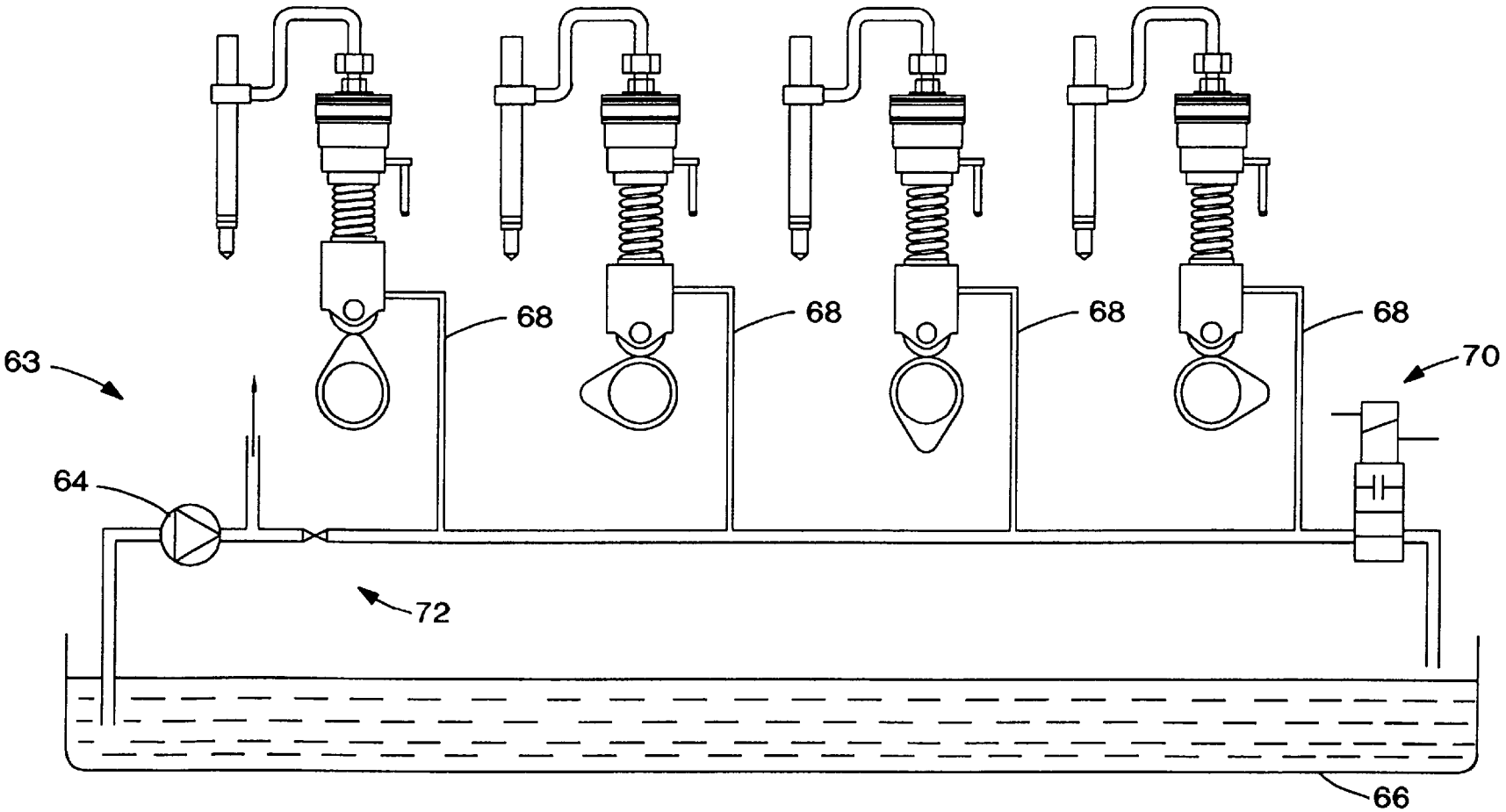
FIG. 6 is a schematic view of an embodiment of the inventive electrohydraulic fuel injection timing control.

Referring to FIGS. 2–4 and 6 and as previously discussed, hydraulic actuation of the advance piston 28, 128, 228, especially when used in conjunction with nested plunger return spring 146, 246 and follower return spring 136, 236, can be accomplished by routing pressurized lubricating oil from the internal combustion engine lubrication system into a hydraulic advance circuit 63. As schematically shown in FIG. 6, the hydraulic advance circuit 63 comprises an internal combustion engine lubricating oil pump 64 which draws oil from an engine oil pan 66, pressurizes the oil and discharges the oil into engine oil galleries 68 each being connected to a separate unit pump 10, 110, 210. By fluidly coupling the oil pump 64 with the pressurized lubricating oil galleries 68, displacement of the advance piston(s) 28, 128, 228 within the cam follower assembly 20, 120, 220 can be controlled. A control device 70 such as, for example, a solenoid valve, may be positioned downstream of the hydraulic advance circuit. The control device 70 may, in turn, be controlled by an electronic control unit (not shown). In this way, the control device 70 controls the pressure acting on the advance piston 28, 128, 228 and thereby the displacement of the advance piston within the follower assembly 20, 120, 220.

The control device 70 may work in cooperation with a feed orifice 72 fluidly disposed in the hydraulic advance circuit between the lube oil pump 64 and advance piston(s). As will be appreciated, by varying parameters, such as, for example, orifice geometry and cross sectional area, the sensitivity of the orifice to oil viscosity can be controlled. A viscosity sensitive flow channel allows the incorporation of a cold start advance feature into the unit pump hydraulic advance 63.

Figure 7:
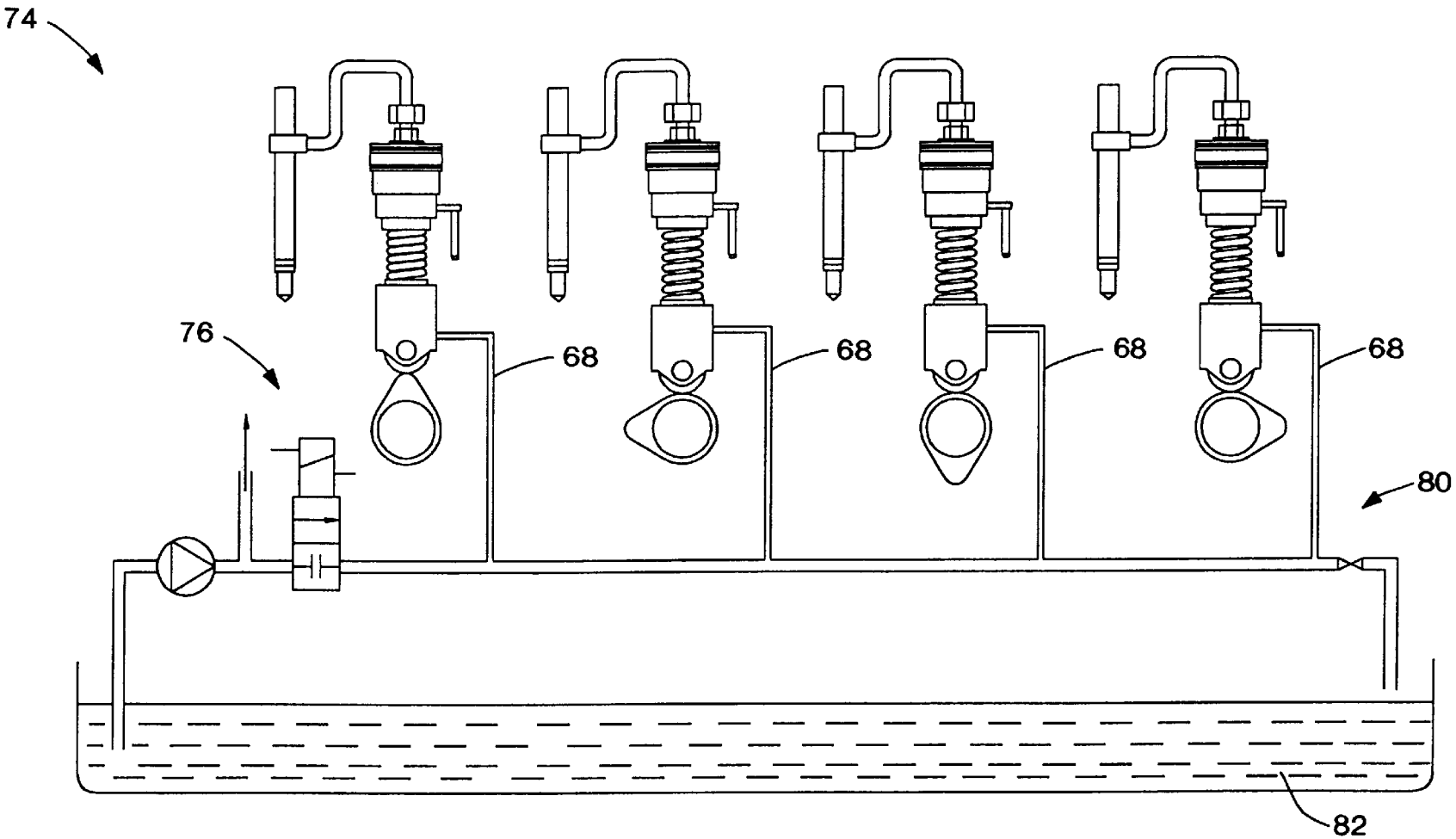
FIG. 7 is a schematic view similar to FIG. 6 of a different embodiment of the inventive electrohydraulic fuel injection timing control.

Another embodiment of a unit pump hydraulic advance is shown generally at 74 in FIG. 7, wherein a control device 76 is located upstream of lubricating oil galleries 78 with a bleed orifice 80 downstream of the oil galleries. In this embodiment, the control device 76 controls the inflow of pressurized lube oil 82 into the hydraulic advance circuit.

Figure 9:
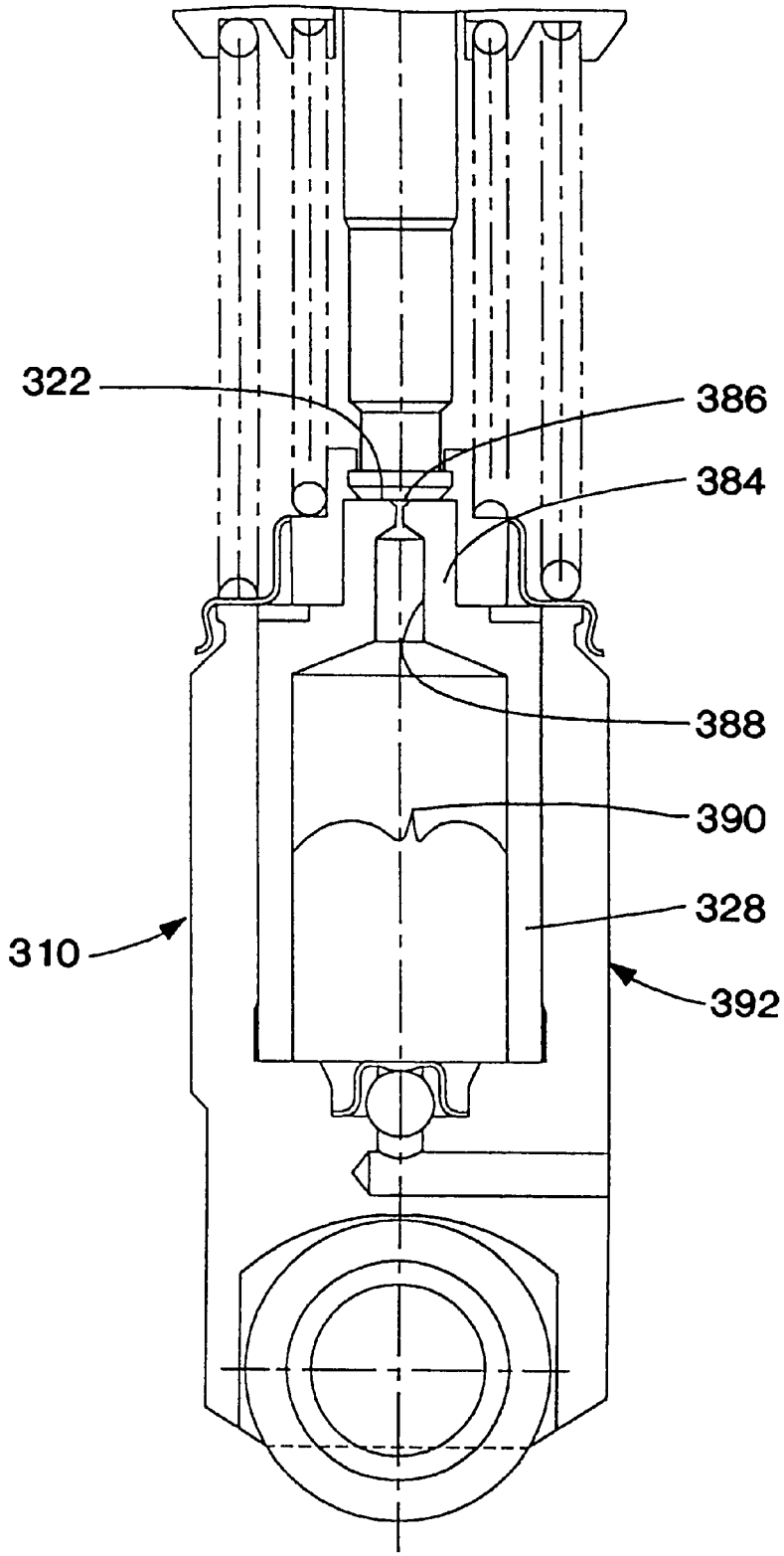
FIG. 9 is a schematical view of another embodiment of a unit pump including an advance piston having a bleed orifice and nested return springs.

FIG. 9 illustrates at 310 a fuel injection unit pump in accordance with still another embodiment of the present invention. The unit pump 310 comprises an advance piston 328 including a stepped engagement wall 384 and an air bleed orifice 386. The stepped engagement wall 384 defines a cylindrical cavity 388 which functions to capture air that may enter into a main cavity 390 when hydraulic fluid located within the main cavity is under low pressure such as during a period of non operation of the advance piston 328 or the fuel system. The air may ingress between seals (not shown) of the advance piston 328 and a body portion 392 of the unit pump 310.

It will be understood that the embodiment of FIG. 9 may, optionally, include a balance spring (not shown), such as described above, located within the main cavity 390.

The air bleed orifice 386 is located, and a pumping plunger driven end 322 is configured, such that the aperture will be completely covered, and intermittently sealed and unsealed, by the pumping plunger driven end. During the up stroke of the unit pump 310, the pumping plunger driven end 322 contacts the stepped upper wall 384 thereby closes the air bleed orifice 386. In this way, the pressure within the main cavity 390 remains steady during the up stroke thereby preventing retraction by the advance piston 328. During the down stroke, the pumping plunger driven end 322 will separate slightly from the advance piston 328 thereby opening the air bleed orifice 386 and allowing the escape of air therethrough.

Accordingly, one aspect of the invention can be understood as comprising the use of a hydraulically actuated advance piston in a fuel injection unit pump or unit injector. The advance piston is disposed between a rotatable cam and pumping plunger. The advance piston has a retracted position, an extended position and may be located anywhere in between. As the advance piston is actuated from the retracted position to the extended position, the pumping plunger is increasingly separated from the cam axis of rotation.

Another aspect of the invention is the use of coaxially nested cam follower assembly and pumping plunger return springs. The use of nested return springs allows a large force to be exerted against the cam follower assembly to maintain the follower in constant contact with the cam. A smaller force is exerted against the pumping plunger to maintain the plunger in constant contact with the advance piston. The use of a low force plunger return spring allows the advance piston to be hydraulically actuated using lubricating oil pressurized by the internal combustion engine.

While preferred embodiments of the foregoing invention have been set forth for purposes of illustration, the foregoing description should not be deemed a limitation of the invention herein. Accordingly, various modifications, adaptations and alternatives may occur to one of ordinary skill in the art without departing from the spirit and scope of the accompanying claims.

What is claimed is:

1. A fuel injector unit pump being driven by a cam and functioning to supply fuel to an injector for an injection event, comprising:

a body;

a pumping plunger reciprocably disposed within the body and comprising a driven end;

a cam follower assembly engaging the cam and comprising a cam follower body defining an advance piston bore, an advance piston which engages the driven end of the pumping plunger for advancing or retarding the timing of the injection event, the advance piston being movable in said advance piston bore relative to said follower body in response to fluid pressure controlled by an advance control, said advance piston comprising bleed means for relieving said fluid pressure;

a follower return spring disposed between the body and the cam follower assembly; and a plunger return spring nested with the follower return spring and between the body and the advance piston.

2. The fuel injector unit pump of claim 1 wherein the plunger return spring is mounted coaxially with the follower return spring.

3. The fuel injector unit pump of claim 1 wherein the advance piston comprises a main cavity and the cam follower assembly comprises a housing and the fuel injector unit pump further comprises:

a balance spring disposed between the main cavity of the advance piston and the housing of the cam follower assembly.

4. The fuel injector unit pump of claim 1 further comprising a follower spring seat mounted coaxially about a plunger spring seat.

5. The fuel injector unit pump of claim 4 wherein:

the follower spring seat comprises a lip which engages the plunger spring seat;

the pumping plunger driven end comprises a flange; and the plunger return spring seat comprises a lip which engages the flange of the pumping plunger driven end.

6. The fuel injector pump of claim 5 wherein the follower spring seat comprises a retainer for connecting the follower spring seat to the follower body.

7. The fuel injector unit pump of claim 1 wherein the advance piston comprises a channel having a depth which defines a distance over which the advance piston may move.

8. The fuel injector unit pump of claim 1 wherein the force of the follower return spring is approximately 30 pounds.

9. The fuel injector unit pump of claim 1 wherein the force of the plunger return spring is approximately 5 pounds.

10. The fuel injector unit pump of claim 1 wherein said bleed means comprises an air bleed orifice located in the advance piston.

11. The fuel injector unit pump of claim 10 wherein:

the advance piston comprises a stepped engagement wall which engages the pumping plunger driven end and the engagement wall defining a cylindrical cavity and the air bleed orifice being centrally located in the engagement wall; and the pumping plunger driven end is configured to close the air bleed orifice during an up stroke of the pumping plunger and open the air bleed orifice during a down stroke thereof.

12. The fuel injector unit pump of claim 1, wherein said cam follower assembly comprises:

a fluid supply bore communicating with the advance piston bore and a fluid supply, the fluid supply bore feeding fluid to the advance piston bore, said fluid displacing the advance piston relative to the cam follower body.

13. The fuel injector unit pump of claim 12, wherein said fluid supply comprises:

a lube oil pump;

a reservoir of lube oil communicating with the lube oil pump;

at least one oil gallery communicating with the fluid supply bore of the cam follower assembly; and a control device for controlling the timing of the flow of lube oil to the oil gallery.

14. The fuel injector unit pump of claim 13 further comprising a feed orifice for providing viscosity sensitivity to the lube oil.

15. The fuel injector unit pump of claim 14 wherein the control device is located between the oil pump and the at least one oil gallery.

16. The fuel injector unit pump of claim 1, wherein the advance piston comprises an engagement wall engaging the driven end of the pumping plunger and said bleed means comprises a bleed orifice defined in said engagement wall; and the pumping plunger driven end is configured to close the bleed orifice during a pumping stroke of the pumping plunger and open the bleed orifice during a return stroke thereof.

17. A fuel injector unit pump being driven by a cam and functioning to supply fuel to an injector for an injection event, comprising:

a body;

a pumping plunger reciprocably disposed within the body and comprising a driven end;

a cam follower assembly engaging the cam and comprising an advance piston which engages the driven end of the pumping plunger for advancing or retarding the timing of the injection event, the advance piston being movable in response to fluid pressure controlled by an advance control; and an air bleed orifice located in the advance piston.

18. The fuel injector unit pump of claim 17 further comprising:

a follower return spring disposed between the body and the cam follower assembly; and a plunger return spring mounted coaxially with the follower return spring and between the body and the advance piston.

19. The fuel injector unit pump of claim 17 wherein the advance piston comprises a stepped engagement wall engaging the pumping plunger driven end and the engagement wall defining a cylindrical cavity and the air bleed orifice being centrally located in the engagement wall; and the pumping plunger driven end is configured to close the air bleed orifice during an up stroke of the pumping plunger and open the air bleed orifice during a down stroke thereof.

20. The fuel injector unit pump of claim 17 wherein the advance piston comprises a main cavity and the cam follower assembly comprises a housing and the fuel injector unit pump further comprises:

a balance spring disposed between the main cavity of the advance piston and the housing of the cam follower assembly.

21. The fuel injector unit pump of claim 20 further comprising a follower spring seat mounted coaxially about a plunger spring seat.

* * * * *